US012723508B2

(12) United States Patent
Lerner et al.

(10) Patent No.: US 12,723,508 B2
(45) Date of Patent: Sep. 1, 2026

(54) DOWNHOLE TRICKLE CHARGE DEVICE, APPARATUS, AND METHOD

(71) Applicant: A.O. International II, Inc., Stafford, TX (US)

(72) Inventors: Daniel Maurice Lerner, Missouri City, TX (US); Andre Orban, Sugar Land, TX (US)

(73) Assignee: A.O. International II, Inc., Houston, TX (US)

( * ) Notice: Subject to any disclaimer, the term of this patent is extended or adjusted under 35 U.S.C. 154(b) by 0 days.

(21) Appl. No.: 19/249,879

(22) Filed: Jun. 25, 2025

(65) Prior Publication Data

US 2026/0002438 A1 Jan. 1, 2026

Related U.S. Application Data

(60) Provisional application No. 63/664,541, filed on Jun. 26, 2024.

(51) Int. Cl.
*E21B 47/12* (2012.01)
*E21B 17/00* (2006.01)
(Continued)

(52) U.S. Cl.
CPC ..... *E21B 47/12* (2013.01); *E21B 17/003* (2013.01); *E21B 34/066* (2013.01); *E21B 47/001* (2020.05)

(58) Field of Classification Search
CPC ..... E21B 47/001; E21B 17/003
See application file for complete search history.

(56) References Cited

U.S. PATENT DOCUMENTS 4,667,986 A 5/1987 Johnson et al.
5,084,664 A 1/1992 Gali
(Continued)

FOREIGN PATENT DOCUMENTS

EP 3501048 B1 4/2020
WO WO-0198632 A1 * 12/2001 ..... E21B 41/0035
(Continued)

OTHER PUBLICATIONS

Park, Tae Wook, International Search Report. Ministry of Intellectual Property. ISA/ILPO. Form PCT/ISA/210. Box C. Oct. 28, 2025, Daejeon, KR.
(Continued)

*Primary Examiner* — Aaron L Lembo
(74) *Attorney, Agent, or Firm* — ePatentManager.com; Guerry L. Grune

(57) ABSTRACT

Apparatus, devices and methods that provide for storage and transfer of energy on demand into a completion well utilizing a subsea pipeline that supplies and transmits energy on demand from energy storage device(s) located at or near a production platform to a wellhead with a well casing that includes communication and power wires connected to the well casing and connects a subsea pipeline distribution section of the wellhead to the subsea pipeline with at least one power and communication pod to which communication and power wires are also connected and provides both power and bidirectional data communication to a multiplicity of sensors and actuators in an upper well portion with a T-connector that provides a connection into one or more energy storage devices allowing trickle charge and recharge of energy storage devices for both power and communication signals that monitor a state of charge of energy device storages over time.

30 Claims, 2 Drawing Sheets

(51) Int. Cl.
*E21B 34/06* (2006.01)
*E21B 47/001* (2012.01)

(56) References Cited

U.S. PATENT DOCUMENTS

| | | | | |
|---|---|---|---|---|
| 5,150,031 | A | 9/1992 | James et al. | |
| 7,011,152 | B2 | 3/2006 | Soelvik | |
| 7,963,335 | B2 | 6/2011 | Krehbiel et al. | |
| 8,453,723 | B2 | 6/2013 | Smithson | |
| 8,967,294 | B2 * | 3/2015 | Rozenblit | E21B 47/12 166/65.1 |
| 9,151,131 | B2 | 10/2015 | Drablier et al. | |
| 9,175,540 | B2 | 11/2015 | Voss et al. | |
| 9,181,942 | B2 | 11/2015 | Batho et al. | |
| 9,759,061 | B2 | 9/2017 | Lerner et al. | |
| 9,816,371 | B2 | 11/2017 | Lerner et al. | |
| 9,874,090 | B2 | 1/2018 | Lerner et al. | |
| 9,896,928 | B2 | 2/2018 | Lerner et al. | |
| 9,927,547 | B2 * | 3/2018 | Wood | E21B 47/125 |
| 9,951,608 | B2 * | 4/2018 | Hudson | E21B 17/0285 |
| 9,957,789 | B2 | 5/2018 | Hallundbaek | |
| 10,221,680 | B2 | 3/2019 | August et al. | |
| 10,472,954 | B2 | 11/2019 | Lerner et al. | |
| 10,480,283 | B2 | 11/2019 | Joseph et al. | |
| 10,738,595 | B2 | 8/2020 | Lerner et al. | |
| 10,871,068 | B2 | 12/2020 | Lerner et al. | |
| 10,890,043 | B2 | 1/2021 | Carlsen et al. | |
| 11,008,854 | B2 | 5/2021 | Oliphant et al. | |
| 11,060,372 | B2 * | 7/2021 | Bourgeau | E21B 33/063 |
| 11,451,170 | B2 | 9/2022 | Williams et al. | |
| 12,018,562 | B2 * | 6/2024 | Dullage | H04B 3/54 |
| 2010/0019930 | A1 | 1/2010 | Biester et al. | |
| 2013/0241741 | A1 | 9/2013 | Hallundbaek | |
| 2016/0251940 | A1 | 9/2016 | De Witt et al. | |
| 2017/0271688 | A1 * | 9/2017 | Shanfield | E21B 41/0085 |
| 2019/0073318 | A1 | 3/2019 | Vaknin et al. | |
| 2019/0353030 | A1 | 11/2019 | Jarvis et al. | |
| 2020/0157906 | A1 * | 5/2020 | Bourgeau | E21B 33/0355 |

FOREIGN PATENT DOCUMENTS

| | | | | |
|---|---|---|---|---|
| WO | 2023107341 | A1 | 6/2023 | |
| WO | WO-2024178005 | A1 * | 8/2024 | E21B 41/0007 |

OTHER PUBLICATIONS

Park, Tae Wook, Written Opinion of the International Searching Authority. Ministry of Intellectual Property. ISA/ILPO. Form PCT/ISA/237, Oct. 28, 2025, Daejeon, KR.

* cited by examiner

DOWNHOLE TRICKLE CHARGE DEVICE, APPARATUS, AND METHOD

PRIORITY

This application is a non-provisional conversion of and claims priority under 35 USC 119 from Provisional Application 63/664,651 filed Jun. 26, 2024, entitled "Downhole Trickle Charge Device, Apparatus, and Method", the entire contents of which are hereby incorporated by reference.

FIELD OF THE INVENTION

The present invention relates to energy storage and transfer systems for completion wells in the oil and gas industry. More specifically, it pertains to a system comprising one or more energy storage devices and TEC line and/or umbilical that supplies and transmits energy from a production platform to a wellhead, facilitating efficient energy management and communication within the well infrastructure.

INTRODUCTION AND BACKGROUND

In the oil and gas industry, the efficient management and transfer of energy to wellheads are critical for the effective operation of completion wells. Traditional methods of energy transfer to wellheads often suffer from significant power losses and inefficiencies, particularly in deep well applications. Furthermore, maintaining reliable communication with downhole sensors and actuators remains a challenge due to the harsh environmental conditions and the complexity of well structures.

Existing systems typically involve cumbersome and inefficient cabling methods, which not only increase installation and maintenance costs but also limit the ability to provide high power levels necessary for advanced downhole operations. These limitations underscore the need for an innovative approach that enhances energy transfer efficiency and ensures robust communication with downhole equipment.

Various approaches have been proposed to address these challenges, including the use of standard power and communication cables, as well as more advanced umbilical systems. Several patents and publications describe energy transfer systems using conventional power lines, while others introduce a hybrid cable for power and data transmission. Despite these advancements, the problem of power loss and unreliable communication persists, particularly in demanding well environments. The current methods of energy transfer to completion wells face significant challenges, including high electrical resistance, power loss, and unreliable communication with downhole sensors and actuators. These issues are exacerbated in deep wells and complex geological formations, where the efficiency and reliability of energy transfer and communication are paramount.

During oil production, it may become necessary to perform maintenance work in a well or to open a production well. Such well work is known as well intervention. A production casing is arranged inside the well and is closed by a well head in its upper end. The well head may be placed on shore, on an oil rig or on the seabed.

During oil production, it may become necessary to perform maintenance work in a well or to open a production well. Such well work is known as well intervention. A production casing is arranged inside the well and is closed by a well head in its upper end. The well head may be placed on shore, on an oil rig or on the seabed.

In order to lower and raise the tool into and out of the well and supply the tool with electricity, the tool is connected to a wireline at its top, which is fed through the well head. In order to seal the well while performing the operation using the tool, the wireline passes through a high-pressure grease injection section and sealing elements for sealing around the wireline.

In order to seal around the wireline as it passes through the grease injection section, high-pressure grease is pumped into the surrounding annulus to effect a pressure-tight dynamic seal which is maintained during the operation by injecting more grease as required. A slight leakage of grease is normal, and the addition of fresh grease allows for the consistency of the seal to be maintained at an effective level. In this way, grease leaks from the grease injection section into the sea during an intervention operation, which is not environmentally desirable. Due to the increasing awareness of the environment, there is a need for a more environmentally friendly solution.

One quick-charge battery charger that has been proposed in recent years detects a voltage drop across a battery being charged to control a charging current in a final charging stage after the battery has been charged at a relatively high current rate. More specifically, as shown in FIG. 1 of the accompanying drawings, while a battery (more particularly a nickel-cadmium battery) is being charged by a battery charger, a constant charging current is supplied to the battery, resulting in the voltage across the battery progressively increasing with time. In the final charging stage, the voltage across the nickel-cadmium battery reaches a peak value Vp, and then drops by $-\Delta V$ from the peak value Vp. When the voltage drop $-\Delta V$ is detected, the charging current is cut off to prevent the nickel-cadmium battery from being excessively charged. After the quick charging current has been cut off, the nickel-cadmium battery is continuously trickle charged with a low current in order to keep the battery fully charged.

Detecting the voltage drop $-\Delta V$ is an effective way of determining when the charging of the battery is completed, because the voltage drop $-\Delta V$ occurs regardless of the discharge rate or ambient temperature of the nickel-cadmium battery.

It is known that a nickel-cadmium battery which has not been in use (i.e., which has been in storage for a long period of time), has its charging capacity reduced because of the inactive state that develops when the battery is stored for a long time. A battery that has been in storage for a long period of time will hereinafter be referred to as a long storage battery. A battery that has been used frequently will hereinafter be referred to as a frequently used battery.

When a long storage battery is charged, a voltage peak known as a pseudo voltage peak, is developed prior to the voltage peak, at completion of the charging process. A voltage drop immediately following a pseudo actual voltage peak at the completion of the charging of the battery always occurs. If the charging current supplied to charge a long storage battery is cut off when the voltage drop subsequent to such a pseudo voltage peak is detected, the battery would not be fully charged.

Given the aforementioned challenges, there is a clear need for an improved system and improved batteries that can efficiently store and transfer energy to completion wells while ensuring reliable communication with downhole sensors and actuators. Such a system should minimize power loss, enhance energy transfer efficiency, and maintain robust bidirectional data communication under various well conditions.

SUMMARY OF THE INVENTION

A primary objective of the present disclosure is to provide apparatus, devices, systems and methods for the efficient storage and transfer of energy to completion wells. Specifically, this invention aims to minimize electrical resistance and power loss during energy transfer from the production platform to the wellhead and within the well. In addition, this disclosure provides for reliable communication that ensures robust bidirectional communication with downhole sensors and actuators. In addition, there is a need for enhanced energy storage to facilitate the trickle charge and recharge of energy storage devices and to provide a reliable energy source for high power operations. The entire apparatus and system is built to provide scalability and allow for adaptation to various well depths and geological formations without compromising performance.

This disclosure also introduces several key features that distinguish it from earlier efforts to accomplish the tasks needed to complete downhole and often subsea oil and gas platforms. One is to provide one or more devices that store and transfer energy on demand to a completion well. This requires use of an umbilical that supplies and transmits energy from energy storage devices located at or near the production platform to the wellhead by integration within the well casing for communication and power lines that connect the umbilical distribution section of the wellhead to the umbilical. In addition, this disclosure provides for a umbilical distribution section of the well which includes at least one power and communication pod connected to the communication and power wires. More specifically, the present disclosure provides for one or more devices that store and transfer energy on demand into a completion well comprising;

a subsea pipeline that supplies and transmits the energy on demand from one or more energy storage devices located at or near a production platform to a wellhead with a well casing that includes one or more communication and power wires connected to the well casing that also connects an subsea pipeline distribution section of the wellhead to the subsea pipeline wherein the subsea pipeline distribution section includes at least one power and communication pod to which the communication and power wires are also connected and wherein the well casing is an outer portion of piping that is fixed into a geological formation that both establishes a production well and seals the well from outer layers of the geological formation and wherein on an inside portion of the well casing is production tubing and on outside of portion of the production tubing are tubing encased conductor (TEC) lines that transmit both low and high power transmitted by both a low power TEC line and a high power TEC line and wherein a low energy/power rated TEC line originates at a power and communication pod and provides both power and bidirectional data communication to a multiplicity of sensors and actuators and wherein in an upper well portion there exists a T-connector that provides a connection into one or more energy storage devices that allows trickle charge and recharge of the energy storage devices with and without communication signals that monitor a state of charge of the energy device storages over time and wherein a high power/energy TEC line delivers a high energy/power rate from the energy storage devices along an entire length of the production well that utilizes a high voltage rated cable which provides an alternate pathway to ensure minimal electrical resistance and power loss to the devices.

Here the subsea pipeline is an umbilical and wherein the umbilical can be used in above ground oil In at least one embodiment, the high power/energy TEC line is attached to one or more valve actuation devices controlled via communication signals from the low power/energy TEC line powered by the high power/energy TEC line in order that both TEC lines operate in tandem when mechanical operation is required so that extra power is supplied for operation of valve actuation devices.

Extra power also passes through the power and communication pod into the low power/energy TEC line and then proceeds to T connection(s) that connect with one or more valve actuation devices.

These actuation devices are selected from one or more of a group consisting of; valves, drills, diverters, chokes, sleeves, turbines, pumps, and gears.

At least three devices exist along the low power/energy TEC line but require additional power delivered by use of the high power/energy TEC line wherein the devices are a low power communications device, a pump controller, and a hydraulic pump, with an electric motor. The T connection comprises one or more connectors or direct wired modules that resides in the lower well portion and connects communications signal and power from the low power/energy TEC line to one or more low power communications devices.

An additional embodiment includes using comprising unique logical communications addresses that transceive data and provide an ability for independent command and control of one or more actuation devices.

Here the low power communications devices require more power than transmitted by the low power/energy TEC line as there often exists multiple actuation devices that require additional power/energy consumption to provide the additional power/energy consumption as well as additional command and control signals.

In this case the datagrams travel along the low power/energy TEC line to a low power module and a high power TEC line that does not support datagrams but supplies power to the pump controller controlled via one or more power communications devices that function as datagram transceivers.

Here the datagrams are transformed into communications signals to operate the pump controller.

In another embodiment, an apparatus that stores and transfers energy on demand into a completion well comprising;

a subsea pipeline that supplies and transmits the energy on demand from one or more energy storage devices located at or near a production platform to a wellhead with a well casing that includes one or more communication and power wires connected to the well casing that also connects an subsea pipeline distribution section of the wellhead to the subsea pipeline wherein the subsea pipeline distribution section includes at least one power and communication pod to which the communication and power wires are also connected and wherein the well casing is an outer portion of piping that is fixed into a geological formation that both establishes a production well and seals the well from outer layers of the geological formation and wherein on an inside portion of the well casing is production tubing and on outside of portion of the production tubing are tubing encased conductor (TEC) lines that transmit both low and high power transmitted by both a low power TEC line and a high power TEC line and wherein a low energy/power rated TEC line originates at a power and communication pod and provides both power and bidirectional data communication to a multiplicity of sensors and actuators and wherein in an upper well portion there exists a T-connector that provides a connection into one or more energy storage devices that allows trickle charge and recharge of the energy storage devices with and without communication signals that monitor a state of charge of the energy device storages over time and wherein a high power/energy TEC line delivers a high energy/power rate from the energy storage devices along an entire length of the production well that utilizes a high voltage rated cable which provides an alternate pathway to ensure minimal electrical resistance and power loss to the devices.

In yet another embodiment, the present also discloses a method for storing and transferring energy on demand into a completion well which transfers energy on demand from accumulated stored energy when limited energy sources are available comprising;

implementing a subsea pipeline that supplies and transmits the energy on demand from one or more energy storage devices located at or near a production platform to a wellhead with a well casing that includes one or more communication and power wires connected to the well casing that also connects a subsea pipeline distribution section of the wellhead to the subsea pipeline wherein the subsea pipeline distribution section includes at least one power and communication pod to which the communication and power wires are also connected and wherein the well casing is an outer portion of piping that is fixed into a geological formation that both establishes a production well and seals the well from outer layers of the geological formation and wherein on an inside portion of the well casing is production tubing and on outside of portion of the production tubing are tubing encased conductor (TEC) lines that transmit both low and high power transmitted by both a low power TEC line and a high power TEC line and wherein a low energy/power rated TEC line originates at a power and communication pod and provides both power and bidirectional data communication to a multiplicity of sensors and actuators and wherein in an upper well portion there exists a T-connector providing a connection into one or more energy storage devices providing trickle charge and recharge of the energy storage devices with and without communication signals that monitor a state of charge of the energy device storages over time and wherein a high power/energy TEC line is delivering a high energy/power rate from the energy storage devices along an entire length of the production well that utilizes a high voltage rated cable which provides an alternate pathway to ensure minimal electrical resistance and power loss to the devices.

DETAILED DESCRIPTION

Figure 1:
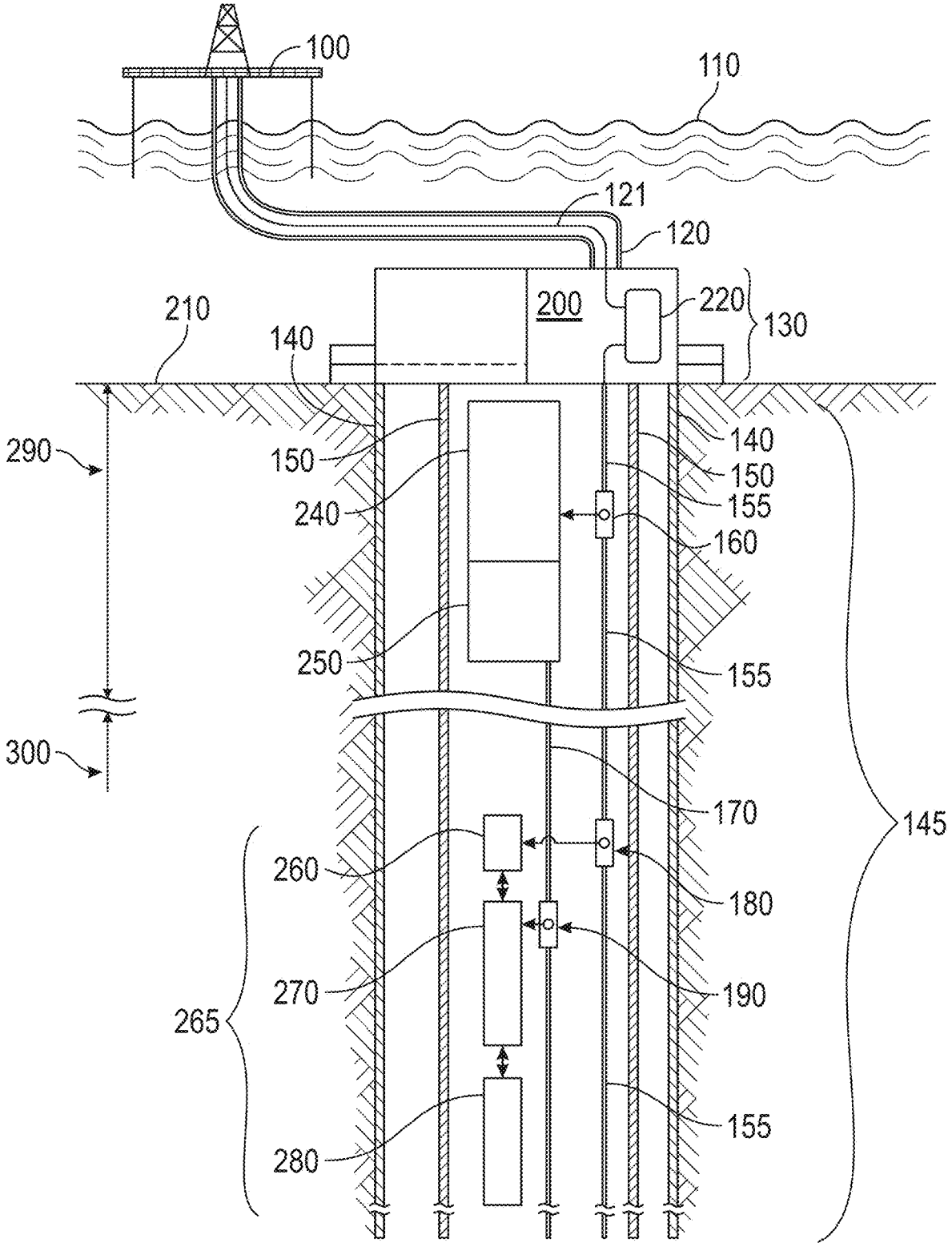
FIG. 1 illustrates a production platform that is located as shown with respect to the sea surface. Here the umbilical from the production platform to the well head connects to the well casing and specifically connects with the umbilical distribution section of the wellhead to the umbilical.

There are at least two embodiments for the present disclosure. These are represented in FIG. 1 which illustrates a low energy/power rate to high energy/power rate isolated power path dual TEC line version of the apparatus and FIG. 2 which illustrates a low energy/power to high energy/power rate single power path bridged single TEC line of the apparatus. Here the well casing and production tubing is fixed into the geological formation, sealing the well and housing the production tubing. The Tubing Encased Conductor (TEC) Lines include low and high power lines that transmit energy along the production tubing. The low power TEC lines provide power and bidirectional data communication to sensors and actuators. In contrast, the high power TEC lines are dedicated to deliver high energy/power rate from energy storage devices along the production well, ensuring minimal electrical resistance and power loss. The low power TEC lines provide delivered power that normally ranges between 20 and 40 watts and the lower power TEC lines would normally require a voltage rating of 300-600 volts. In a conventional or modern oil and gas well formation, due to increased temperatures with depth (up to 30,000 ft.), the electrical resistance significantly increases, and the electrical insulation demands require high thermal ratings to ensure proper power delivery. For the high power TEC lines it is necessary to supply a power range for 50-100 watts which would also necessitate also at least 300-600 volts.

Here the Step-by-Step Process for determining the wire and insulation requirements for a "conventional" 30,000-foot TEC line is presented.

1. Determine Operating Voltage:
   Higher transmission voltage is preferred for long distances to reduce current and minimize voltage drop. For this example, 240V as the transmission voltage is used.
2. Calculate Current:
   Using the power formula $P=V\times I$:
   For 50 W: I=50 W/240V approximately equals 0.208 A
   For 100 W: I=100 W/240V approximately equals 0.417 A
3. Select Wire Guage Considering Voltage Drop:
   Voltage drop is significant over long distances. Use the voltage drop formula:

$$\text{Voltage Drop}=2\times\text{Length}\times\text{Current}\times\text{Resistance per unit length}$$

The resistance per unit length depends on the wire gauge and material (copper, aluminum, etc.).
   For long distances, thicker wires (lower gauge numbers) are required to minimize voltage drop.
4. Check Voltage Drop for Different Gauges:
   Assume copper wire with resistivity values:
   10 AWG: approximately 0.9989 ohms per 1000 feet
   8 AWG: approximately 0.6282 ohms per 1000 feet
   6 AWG: approximately 0.3951 ohms per 1000 feet
   Total resistance for 30,000 feet:
   10 AWG: 30×0.9989~29.967 ohms
   8 AWG: 30×0.6282~18.846 ohms
   6 AWG: 30×0.3951~11.853 ohms Voltage Drop Calculation:
For 50 W (0.208 A), 240V:
10 AWG: 2×0.208 A×29.967≈12.47V
8 AWG: 2×0.208 A×18.846≈7.84V
6 AWG: 2×0.208 A×11.853≈4.93V
For 100 W (0.417 A), 240V:
10 AWG: 2×0.417 A×29.967≈25.00V
8 AWG: 2×0.417 A×18.846≈15.71V
6 AWG: 2×0.417 A×11.853≈9.90V 5. Ensure Adequate Insulation Voltage Rating:
The voltage rating of the wire's insulation must be higher than the operating voltage.
For a 240V system, use wire with a minimum 300V insulation rating.
Consider higher voltage insulation (e.g., 600V) for added safety and flexibility.

Example Calculation

For a 240V system and a 10 AWG wire:
Power Range: 50 W-100 W
Current Range: 0.208 A-0.417 A
Voltage Drop for 50 W: 12.47V (significant, may need thicker wire like 8 AWG or 6 AWG)
Voltage Drop for 100 W: 25.00V (to high, requires thicker wire)
For 8 AWG wire:
Voltage Drop for 50 W: 7.84V (acceptable)
Voltage Drop for 100 W: 15.71V (may be acceptable depending on tolerance)
For 6 AWG wire:
Voltage Drop for 50 W: 4.93V (more acceptable)
Voltage Drop for 100 W: 9.90V (more acceptable)

Conclusion

Voltage Rating of Wire: Use wire with at least 300V insulation rating, preferably 600V for added safety.
Wire Guage: Use thicker wire to minimize voltage drop over 30,000 feet, For 50-100 W of power at 240V:
8 AWG may be acceptable for lower end of power range (50 W).
6 AWG is better for the higher end of power range (100 W)

Conclusion

Voltage Rating of Wire: Use wire with at least a 300V insulation rating, preferably 600V for added safety.
Wire Gauge: Use thicker wire to minimize voltage drop over 30,000 feet. For 50-100 watts of power at 240V:
8 AWG may be acceptable for lower end of power range (50 W).
6 AWG is better for the higher end (100 W).

However, for the TEC lines required for downhole well completion it is not desirable to use any wire gauge greater than 12 AWG. This results in creating engineering tradeoffs which necessitated the embodiments of the present disclosure.

Always ensure compliance with local electrical codes and consult an electrical engineer for precise calculations and safety compliance for such long-distance power transmission.

A key salient feature is the one or more T-connectors that exist at least in the upper well portion of the downhole oil and gas exploration well that connects to energy storage devices, enabling trickle charge and recharge with and without communication signals for monitoring the state of charge.

FIG. 1 illustrates a production platform (100) that is located as shown with respect to the sea surface (110). Here the umbilical (120) from the production platform to the well head (130) (containing a communication and power wire-121) connects to the well casing (140) and specifically connects with the umbilical distribution section (200) of the wellhead (120) to the umbilical (120). Within the umbilical distribution section (200) there exists at least one power and communication pod (220) and the communication and power wire (121) connects to the power and communication pod(s) (220). The umbilical distribution section (200) typically includes power and communication pods (220) that communicate and control electrical systems within the well. In this instance the well head (130) is sitting on the sea bed (210). The well casing (140) is the outer portion of piping that is cemented into the formation which becomes the well and seals the well from outer layers of the geological formation and normally runs the entire length of the well in stages.

Inside of the casing (140) is production tubing (150) for the petrochemical production by the well. On the outside of the production tubing (150) are electrical control and communication lines (155) known as TEC (tubing encased conductors). The upper well portion (290) is at a lower temperature than the lower well portion (300) where the petrochemicals are being produced from the geological formation. Because the upper well portion (290) is at a lower temperature and the casing (140) of a larger diameter than the lower well portion (300), the well upper portion is a suitable location for the energy storage device (240) due to the fact that this location provides an abundant unused area for the energy storage device (240). The low power TEC line (155) originates at the power and communication pod(s) (220) and provides both power and bidirectional data communication to a multiplicity of sensors and actuators that are utilized through the length of the entire well. Many wells are able to utilize a single TEC line with conductors having electrical return(s) through the well production tubing (150). For the entire production well (145) the system includes one or more T-connectors (160, 180) that allow for electrical and communications access into and out of the low power TEC line (155). In the upper well portion (290) there exists a T-connector (160) that provides a connection into the energy storage device(s) (240) to allow for trickle charge (slow) recharge of the energy storage device(s) (240) and optional communications to monitor the state of the charge over time.

A high rate energy delivery system (250) is connected to the energy storage device (240). This high rate energy delivery system (250) converts power in the form of energy from the energy storage device (240) and delivers the energy/power to a high power TEC line (170) which runs the entire length of the production well (145). This high power TEC line (170) includes a high voltage rated cable in order to provide an alternate pathway with minimal electrical resistance and power loss to the devices within the overall production well (145).

As defined herein, the lower well portion of the well completion system produces the petrochemicals from the geological formation while the upper well portion transports these petrochemicals to the surface. In cases where surface signals are required to monitor and control downhole flow control devices, the lower well portion requires more power and therefore more energy consumption than the upper portion well portion.

The valve actuation devices (265) which includes (260, 270, and 280) is controlled through the communications on the low energy TEC line and powered by the high energy TEC line-so that they work in tandem as required when valve operation is needed. The concept is to supply extra power so that the communications signals originate on the production platform (100) via the umbilical communications wire (121) through the pod (220) into the low power TEC line (155) which proceeds to T connection(s) (160) to connect with each actuation device such as valves, drills, diverters, chokes, sleeves, turbines, pumps, gears, etc. Here, there is shown three modules that include a low power communications device (260), a pump controller (270), and a hydraulic pump with an electric motor (280). These three modules represent one of several embodiments of actuation device(s) (265) that require more power than can be delivered by the low power TEC line (155).

The T connection (180) which could be one or more connectors or direct wired, which resides in the lower well portion (300) connects communications signal and power from low power TEC line (155) to the low power communications device (260). In many cases the low power communications device (260) will have a unique logical communications address to allow for transceiving data that will provide the ability for independent command and control of one or more actuation device(s) (265). This low power communications device (260) requires much less power than the low power TEC line (155) because there could and often exist multiple actuation devices that need command and control. In addition, the device (270) the pump controller is connected to the high power TEC line (170) with the high power T connection (190) to provide sufficient power to operate at least one controller at its full rated specifications. The pump controller (270) is connected to the lower power communications device (260) which provides the command and control necessary to operate the pump controller (270). The pump controller (270) is connected to the hydraulic pump with an electric motor (280). The hydraulic pump with an electric motor (280) is precisely monitored and controlled by the pump controller (270) to enable the pump to deliver necessary hydraulic fluid to the proper locations (multidirectional, etc.) in order to facilitate positioning and functioning of one or more production valves (not shown).

In the case of using datagrams, the datagrams are traveling in the low power TEC line (155) to the low power module (260) and the high power TEC line (170) with no datagram is simply supplying the power to the pump controller (270) and the pump controller (270) is being controlled via the lower power communications devices (260) which in this case functions as the datagram transceiver. The datagrams are translated into signals to operate the pump controller (270).

Datagrams are described in detail in U.S. Pat. Nos. 9,759,061, 9,816,371, 9,874,090, 9,896,928, 10,472,954, 10,738,595, and 10,871,068, the entirety of which are incorporated by reference herein.

Figure 2:
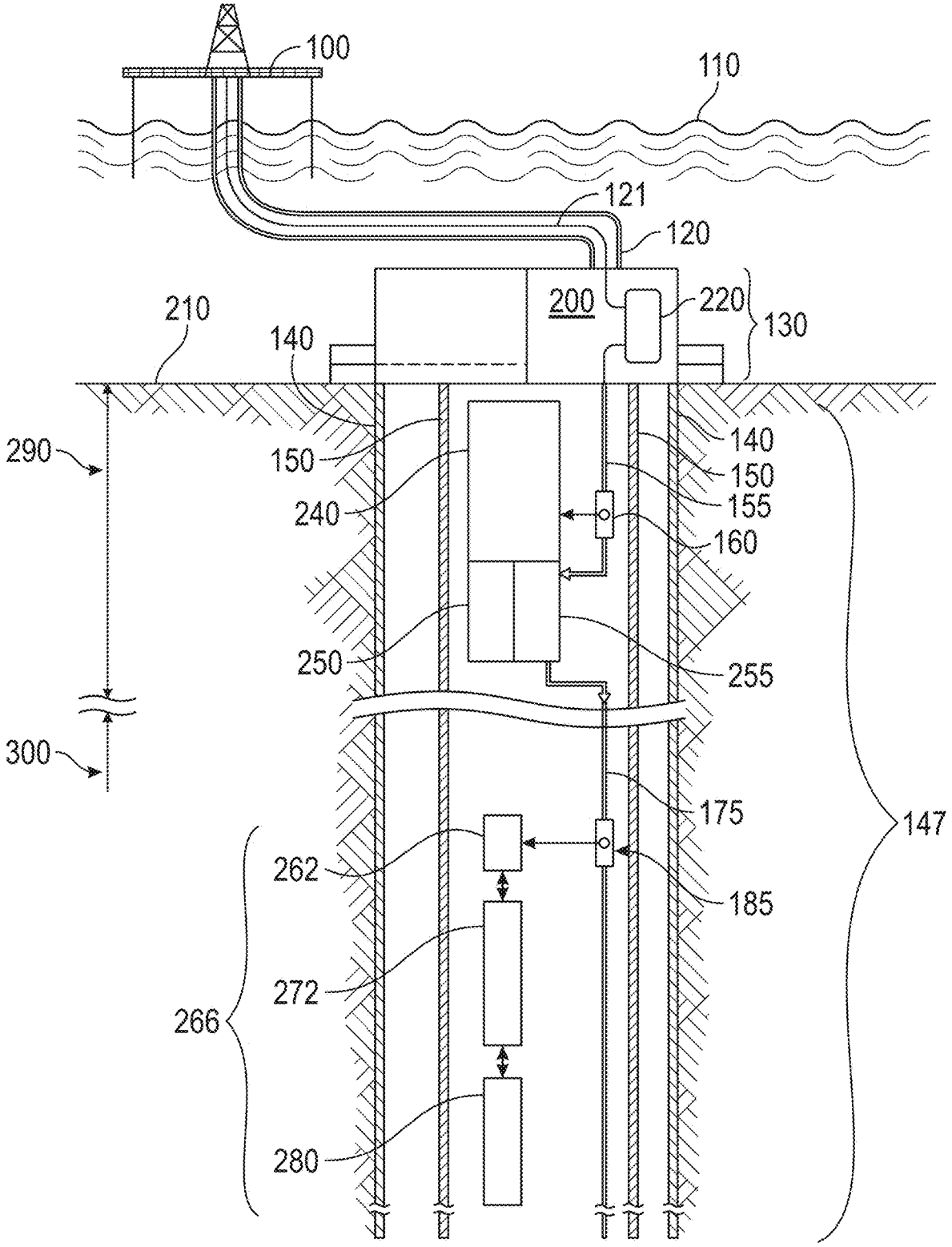
FIG. 2 illustrates the low energy/power TEC line terminates in a low power/high power communications bridge to bridge communication signals between the low power TEC line and a combined high power plus signals TEC line. The high power portion of the communications bridge is a combination of high power from a high power module and the communications signals that are sent along the low power TEC line.

For FIG. 2 the diagram shows that the low energy/power TEC line (155) terminates in a low power/high power communications bridge (255) to bridge communication signals between the low power TEC line (155) and a combined high power plus signals TEC line (175). The high power portion of the communications bridge (255) is a combination of high power from a high power module (250) and the communications signals that are sent along the low power TEC line (155).

In this case the communications signals are coming into the LP/HP communications bridge (255) and continue in a low power mode into the combined high power plus signals TEC line (175). This provides an advantage in that it eliminates the need to run both a low power and high power TEC line (2 lines). This advantage results in enormous cost and labor savings as well as providing an ability to utilize a high energy rate delivery system to supply a combination of power and communications signals to all of the actuation devices in the well lower portion (300). More specifically, in FIG. 2 is also shown a production platform (100) that is located as shown with respect to the sea surface (110). Here the umbilical (120) from the production platform to the well head (130) (containing a communication and power wire—121) connects to the well casing (140) and specifically connects with the umbilical distribution section (200) of the wellhead (130) to the umbilical (120). Within the umbilical distribution section (200) there exists at least one power and communication pod (220) and the communication and power wire (121) connects to the power and communication pod(s) (220). The umbilical distribution section (200) typically includes power and communication pods (220) that communicate and control electrical systems within the well. In this instance, the well head (130) is sitting on the seabed (210). The well casing (140) is the outer portion of piping that is cemented into the formation which becomes the well and seals the well from outer layers of the geological formation and normally runs the entire length of the well in stages.

Inside of the casing (140) is production tubing (150) for the petrochemical production by the well. On the outside of the production tubing (150) are electrical control and communication lines (155) known as TEC (tubing encased conductors). The upper well portion (290) is at a lower temperature than the lower well portion (300) where the petrochemicals are being produced from the geological formation. Because the upper well portion (290) is at a lower temperature and the casing (140) of a larger diameter than the lower well portion (300), the well upper portion is a suitable location for the energy storage device (240) due to the fact that this location provides an abundant unused area for the energy storage device (240). The low power TEC line (155) originates at the power and communication pod(s) (220) and provides both power and bidirectional data communication to a multiplicity of sensors and actuators that are utilized through the length of the entire well. In the upper well portion (290) there exists a T-connector (160) that provides a connection into the energy storage device(s) (240) to allow for trickle charge (slow) recharge of the energy storage device(s) (240) and optional communications to monitor the state of the charge over time.

A high rate energy delivery system (250) is connected to the energy storage device (240). This high rate energy delivery system (250) converts power in the form of energy from the energy storage device (240) and delivers the energy/power to a combined high power plus signals TEC line (175) through the communications bridge with high power pass through (255) which runs the balance of the entire length of the production well with single TEC line (147). This combined high power plus signal TEC line (175) includes a high voltage rated cable in order to provide a pathway with minimal electrical resistance and power loss to the devices within the overall production well with a single TEC line (147).

The valve actuation devices provided with combined power and communications (266) which includes (262, 272, and 280) is controlled through the communications on combined high power plus signal TEC line (175). Here, there is shown three modules that include a communications transceiver with high power pass though device (262), that also allows for power into a pump controller with internal high power input (272), and a hydraulic pump with an electric motor (280). These three modules represent one of several embodiments of valve actuation device(s) (266) that are now powered by the combined high power plus signal TEC line (175).

The high power T connection (185) allows the high power plus signal TEC line (175) to pass through and provide power in at least 2 directions and this high power T connection (185) could be one or more connectors or direct wired. Here the high power T-connection (185) resides in the lower well portion (300) and connects with the combined high power plus signal TEC line (175).

In many cases the communications transceiver with high power pass though device (262) will have a unique logical communications address to allow for transceiving data that will provide the ability for independent command and control of one or more valve actuation device(s) (266). This communications transceiver with high power pass though device (262) receives power from the combined high power plus signal TEC line (175). In addition, the internal high power input (272) pump controller is connected directly to the high power pass though device (262). The internal high power pump controller (272) is connected to the high power pass though device (262) which provides the command and control necessary to operate the internal high power input pump controller (272). The internal high power input pump controller (272) is connected to the hydraulic pump with an electric motor (280). The hydraulic pump with an electric motor (280) is precisely monitored and controlled by the internal high power input pump controller (272) to enable the pump to deliver necessary hydraulic fluid to the proper locations (multidirectional, etc.) in order to facilitate positioning and functioning of one or more production valves (not shown).

In the case of using datagrams, the datagrams are traveling in the combined high power plus signal TEC line (175). This combined high power plus signal TEC line (175) supplies both power and communications to the internal high power input pump controller (272) which is being controlled via the high power pass though device (262) which in this case functions as the datagram transceiver. The datagrams are translated into signals to operate the internal high power input pump controller (272).

The claims as provided in the present disclosure describe one or more embodiments of the present disclosure provides a comprehensive solution for the efficient storage and transfer of energy to completion wells. By integrating advanced energy storage devices, an umbilical system, and tubing encased conductor lines, it significantly improves energy transfer efficiency and communication reliability. This results in a more effective and resilient energy management system for completion wells, capable of meeting the demands of modern oil and gas operations. The claims as presented herein and the foregoing description of preferred embodiments of the present invention has been provided for purposes of illustration and description. It is not intended to be exhaustive or to limit the invention to the precise form disclosed, and many modifications and variations will be apparent to those of ordinary skill in the art.

We claim:

1. One or more devices that store and transfer energy on demand into a completion well comprising; a subsea pipeline that supplies and transmits said energy on demand from one or more energy storage devices located at or near a production platform to a wellhead with a well casing that includes one or more communication wires and one or more power wires connected to said well casing that also connects a subsea pipeline distribution section of said wellhead to said subsea pipeline wherein said subsea pipeline distribution section includes at least one power and communication pod to which said communication wires and said one or more power wires are also connected and wherein said well casing is an outer portion of piping that is fixed into a geological formation that both establishes a production well and seals said well from outer layers of said geological formation and wherein said well casing is production tubing and on an outside portion of on outside of portion of said production tubing are tubing encased conductor (TEC) lines that transmit both low and high power transmitted by both a low power TEC line and a high power TEC line and wherein a low energy/power rated TEC line originates at a power and communication pod and provides both power and bidirectional data communication to a multiplicity of sensors and actuators and wherein in an upper well portion there exists a T-connector that provides a connection into said one or more energy storage devices that allows trickle charge and recharge of said energy storage devices to monitor a state of charge of said energy storage devices over time via communication signals and wherein a high power/energy TEC line delivers a high power/energy rate from said one or more energy storage devices along an entire length of said production well that utilizes a high voltage rated cable which provides an alternate pathway to ensure minimal electrical resistance and power loss to said devices.

2. The subsea pipeline of claim 1, wherein said subsea pipeline is an umbilical and wherein said umbilical can be used in above ground oil and gas exploration platforms.

3. The one or more devices of claim 1, wherein said high power/energy TEC line is attached to one or more valve actuation devices controlled via communication signals from said low power/energy TEC line powered by said high power/energy TEC line in order that both TEC lines operate in tandem when mechanical operation is required so that extra power is supplied for operation of valve actuation devices.

4. The one or more devices of claim 1, wherein said extra power also passes through said power and communication pod into said low power/energy TEC line and then proceeds to T connection(s) that connect with one or more valve actuation devices.

5. The one or more devices of claim 3, wherein one or more actuation devices are selected from one or more of a group consisting of, valves, drills, diverters, chokes, sleeves, turbines, pumps, and gears.

6. The one or more devices of claim 1, comprising at least three devices that exist along said low power/energy TEC line but require additional power delivered by use of said high power/energy TEC line wherein said devices are a low power communications device, a pump controller, and a hydraulic pump, with an electric motor.

7. The one or more devices of claim 2, wherein said T connection comprises one or more connectors or direct wired modules that resides in said lower well portion and connects communications signal and power from said low power/energy TEC line to one or more low power communications devices.

8. The one or more low power communications devices of claim 6, comprising unique logical communications addresses that transceive data and provide an ability for independent command and control of one or more actuation devices.

9. The low power communications devices of claim 6, wherein said communications devices require more power than transmitted by said low power/energy TEC line as there often exists multiple actuation devices that require additional power/energy consumption to provide said additional power/energy consumption as well as additional command and control signals.

10. The low power/energy TEC line to one or more low power communications devices of claim 5, wherein datagrams travel along said low power/energy TEC line to a low power module and a high power TEC line that does not support datagrams but supplies power to said pump controller controlled via one or more power communications devices that function as datagram transceivers.

11. The datagrams of claim 10 wherein said datagrams are transformed into communications signals to operate said pump controller.

12. An apparatus that stores and transfers energy on demand into a completion well comprising;

a subsea pipeline that supplies and transmits said energy on demand from one or more energy storage devices located at or near a production platform to a wellhead with a well casing that includes one or more communication and power wires connected to said well casing that also connects a subsea pipeline distribution section of said wellhead to said subsea pipeline wherein said subsea pipeline distribution section includes at least one power and communication pod to which said communication and power wires are also connected and wherein said well casing is an outer portion of piping that is fixed into a geological formation that both establishes a production well and seals said well from outer layers of said geological formation and wherein on an inside portion of said well casing is production tubing and on outside of portion of said production tubing are tubing encased conductor (TEC) lines that transmit both low and high power transmitted by both a low power TEC line and a high power TEC line and wherein a low energy/power rated TEC line originates at a power and communication pod and provides both power and bidirectional data communication to a multiplicity of sensors and actuators and wherein in an upper well portion there exists a T-connector that provides a connection into said one or more energy storage devices that allows trickle charge and recharge of said energy storage devices to monitor a state of charge of said energy storage devices over time via communication signals and wherein a high power/energy TEC line delivers a high power/energy rate from said one or more energy storage devices along an entire length of said production well that utilizes a high voltage rated cable which provides an alternate pathway to ensure minimal electrical resistance and power loss to said devices.

13. The subsea pipeline of claim 12, wherein said subsea pipeline is an umbilical and wherein said umbilical can be used in above ground oil and gas exploration platforms.

14. The apparatus of claim 12, wherein said high power/energy TEC line is attached to one or more valve actuation devices controlled via communication signals from said low power/energy TEC line powered by said high power/energy TEC line in order that both TEC lines operate in tandem as required when valve operation is required so that extra power is supplied for communications signals that originate on said production platform that utilizes an subsea pipeline communications wire that passes through said power and communication pod into said low power/energy TEC line and then proceeds to T connection(s) that connect with one or more actuation devices.

15. The apparatus of claim 14, wherein one or more actuation devices are selected from one or more of a group consisting of; valves, drills, diverters, chokes, sleeves, turbines, pumps, and gear.

16. The apparatus of claim 15, comprising at least three devices that exist along said low power/energy TEC line but require additional power delivered by use of said high power/energy TEC line wherein said devices are a low power communications device, a pump controller, and a hydraulic pump, with an electric motor.

17. The apparatus of claim 14, wherein said T connection is one or more connectors or direct wired modules that resides in said lower well portion and connects communications signal and power from said low power/energy TEC line to one or more low power communications devices.

18. The one or more low power communications devices of claim 17, wherein that include unique logical communications addresses that transceive data and provide an ability for independent command and control of one or more actuation devices.

19. The low power communications devices of claim 17, wherein said communications devices require more power than transmitted by said low power/energy TEC line as there often exists multiple actuation devices that require additional power/energy consumption to provide additional command and control signals.

20. The low power/energy TEC line to one or more low power communications devices of claim 15, wherein datagrams travel along said low power/energy TEC line to a low power module and a high power TEC line that does not support datagrams but supplies power to said pump controller controlled via one or more power communications devices that function as datagram transceivers.

21. The datagrams of claim 20, wherein said datagrams are transformed into communications signals to operate said pump controller.

22. A method for storing and transferring energy on demand into a completion well which transfers energy on demand from accumulated stored energy when limited energy sources are available comprising;

implementing a subsea pipeline that supplies and transmits said energy on demand from one or more energy storage devices located at or near a production platform to a wellhead with a well casing that includes one or more communication and power wires connected to said well casing that also connects a subsea pipeline distribution section of said wellhead to said subsea pipeline wherein said subsea pipeline distribution section includes at least one power and communication pod to which said communication and power wires are also connected and wherein said well casing is an outer portion of piping that is fixed into a geological formation that both establishes a production well and seals said well from outer layers of said geological formation and wherein on an inside portion of said well casing is production tubing and on outside of portion of said production tubing are tubing encased conductor (TEC) lines that transmit both low and high power transmitted by both a low power TEC line and a high power TEC line and wherein a low energy/power rated TEC line originates at a power and communication pod and provides both power and bidirectional data communication to a multiplicity of sensors and actuators and wherein in an upper well portion there exists a T-connector that provides a connection into said one or more energy storage devices that allows trickle charge and recharge of said energy storage devices to monitor a state of charge of said energy storage devices over time via communication signals and wherein a high power/energy TEC line delivers a high power/energy rate from said one or more energy storage devices along an entire length of said production well that utilizes a high voltage rated cable which provides an alternate pathway to ensure minimal electrical resistance and power loss to said devices.

23. The method of claim 22, wherein said subsea pipeline is an umbilical and wherein said umbilical can be used in above ground oil and gas exploration platforms.

24. The method of claim 22, wherein said high power/energy TEC line is attached to one or more valve actuation devices controlled via communication signals from said low power/energy TEC line powered by said high power/energy TEC line in order that both TEC lines operate in tandem as required when valve operation is required so that extra power is supplied for communications signals that originate on said production platform that utilizes an subsea pipeline communications wire that passes through said power and communication pod into said low power/energy TEC line and then proceeds to T connection(s) that connect with one or more actuation devices.

25. The method of claim 24, wherein one or more actuation devices are selected from one or more of a group consisting of, valves, drills, diverters, chokes, sleeves, turbines, pumps, and gear.

26. The method of claim 25 comprising at least three devices that exist along said low power/energy TEC line but require additional power delivered by use of said high power/energy TEC line wherein said devices are a low power communications device, a pump controller, and a hydraulic pump, with an electric motor.

27. The method of claim 24, wherein said T connection is one or more connectors or direct wired modules that resides in said lower well portion and connects communications signal and power from said low power/energy TEC line to one or more low power communications devices.

28. The one or more low power communications devices of claim 27, wherein that include unique logical communications addresses that transceive data and provide an ability for independent command and control of one or more actuation devices.

29. The low power communications devices of claim 27, wherein said communications devices require more power than transmitted by said low power/energy TEC line as there often exists multiple actuation devices that require additional power/energy consumption to provide additional command and control signals.

30. The low power/energy TEC line to one or more low power communications devices of claim 27, wherein datagrams travel along said low power/energy TEC line to a low power module and wherein said datagrams are transformed into communications signals and a high power TEC line that supplies power to said pump controller controlled via one or more power communications devices that function as datagram transceivers but does not directly support datagram travel.

* * * * *